US009724617B2

(12) United States Patent
Lin

(10) Patent No.: US 9,724,617 B2
(45) Date of Patent: Aug. 8, 2017

(54) SNAP-FIT CONNECTOR AND TOY ASSEMBLY HAVING THE SAME

(71) Applicant: Genius Toy Taiwan Co., Ltd., Taichung (TW)

(72) Inventor: Wen-Bang Lin, Taichung (TW)

(73) Assignee: Genius Toy Taiwan Co., Ltd., Taichung (TW)

( * ) Notice: Subject to any disclaimer, the term of this patent is extended or adjusted under 35 U.S.C. 154(b) by 77 days.

(21) Appl. No.: 14/681,135

(22) Filed: Apr. 8, 2015

(65) Prior Publication Data

US 2016/0121235 A1 May 5, 2016

(30) Foreign Application Priority Data

Nov. 3, 2014 (TW) ..... 103138058 A

(51) Int. Cl.
*A63H 33/04* (2006.01)
*A63H 33/10* (2006.01)
*A63H 3/46* (2006.01)

(52) U.S. Cl.
CPC ..... *A63H 33/101* (2013.01); *A63H 3/46* (2013.01)

(58) Field of Classification Search
CPC ..... Y10T 403/7039; Y10T 403/60; Y10T 403/606; Y10T 24/45524; Y10T 24/45529; A44B 11/266; E04B 2001/1927; E04C 5/161; B25B 7/02; B25B 7/08; B25B 7/22; A63H 3/16; A63H 33/04; A63H 33/062; A63H 33/101; A63H 33/105; F16M 13/02; A47B 95/008; A47B 96/061; A47F 5/0823
See application file for complete search history.

(56) References Cited

U.S. PATENT DOCUMENTS 1,973,536 A * 9/1934 Mack ..... A63H 33/062 403/171
2,112,247 A * 3/1938 McLoughlin ..... A63H 33/101 24/20 EE
2,132,647 A * 10/1938 Robins ..... A63H 33/108 446/94
2,319,992 A * 5/1943 Hubbard ..... B25G 1/04 174/5 R
2,487,654 A * 11/1949 Hoffman ..... A63H 33/102 446/121
2,762,639 A * 9/1956 Molter ..... A47B 47/0008 256/65.08
3,004,364 A * 10/1961 Benkelman ..... A63H 33/108 446/122
3,229,334 A * 1/1966 Thome ..... A47B 47/0025 403/173

(Continued)

*Primary Examiner* — Aarti B Berdichevsky
*Assistant Examiner* — Urszula M Cegielnik
(74) *Attorney, Agent, or Firm* — Trop Pruner & Hu, P.C.

(57) ABSTRACT

A snap-fit connector includes a female component and a male component. The female component has a retaining hole and two through bores communicating spatially with the retaining hole. The male component has two spaced-apart hooks inserted into the retaining hole. Each of the hooks has a resilient arm, and a protrusion retained in a respective one of the through bores. The protrusion of each of the hooks has an abutment surface abutting against the female component, and a positioning recess formed in a guide surface thereof and accessible via the respective one of the through bores.

13 Claims, 20 Drawing Sheets

(56) References Cited

U.S. PATENT DOCUMENTS 3,374,917 A * 3/1968 Troy ..... A63H 33/08 206/504
3,844,013 A * 10/1974 Hall, Jr. ..... B25B 7/02 29/764
3,921,332 A * 11/1975 Terzian ..... A63H 3/46 446/380
4,044,497 A * 8/1977 Bettens ..... A63H 33/042 403/170
4,104,952 A * 8/1978 Brass ..... A63H 33/101 411/500
4,110,932 A * 9/1978 Brass ..... A63H 33/101 446/86
4,118,888 A * 10/1978 Ogawa ..... A63H 33/26 124/16
4,169,395 A * 10/1979 Hoskinson ..... B25B 7/22 81/421
4,185,411 A * 1/1980 Fischer ..... A63H 33/04 446/124
4,305,221 A * 12/1981 Chatani ..... A63H 33/04 446/121
4,392,323 A * 7/1983 Rubik ..... A63F 9/08 273/153 S
D272,167 S * 1/1984 Chatani ..... D21/499
4,551,110 A * 11/1985 Selvage ..... A63H 33/10 24/DIG. 53
4,617,001 A * 10/1986 Parein ..... A63H 33/105 403/56
4,702,702 A * 10/1987 Mikelsaar ..... G09B 23/26 434/278
4,790,789 A * 12/1988 Mathis ..... A63H 3/46 403/90
4,942,637 A * 7/1990 Yeang-Yai ..... B25B 7/00 7/135
5,000,713 A * 3/1991 Cheng ..... A63H 33/06 273/160
5,044,960 A * 9/1991 De Porteous ..... A63H 3/46 434/267
5,113,727 A * 5/1992 Foster ..... B25B 7/04 81/421
5,186,672 A * 2/1993 Tung ..... A63H 33/10 446/108
5,237,890 A * 8/1993 Gill ..... B66F 13/00 24/615
D356,609 S * 3/1995 Glynn ..... D21/486
5,421,556 A * 6/1995 Dodge ..... E04H 17/20 256/1
5,453,034 A * 9/1995 Larws ..... A63H 33/062 446/103
5,542,871 A * 8/1996 Gabriel ..... A63H 33/101 24/615
5,626,435 A * 5/1997 Wohlhuter ..... B60D 1/52 280/416.1
5,630,250 A * 5/1997 Chou ..... A45C 13/262 16/113.1
5,653,000 A * 8/1997 Lee ..... A45C 13/262 16/113.1
5,725,411 A * 3/1998 Glynn ..... A63H 33/086 403/4
5,735,031 A * 4/1998 Johnson ..... B25B 7/02 29/235
5,853,314 A * 12/1998 Bora ..... A63H 33/086 446/102
5,971,823 A * 10/1999 Sanso ..... A63B 67/007 441/136
6,008,452 A * 12/1999 Lux, Jr. ..... H02G 9/10 174/37
6,023,833 A * 2/2000 Jacobsmeier ..... B25B 31/00 29/243.56
6,223,391 B1 * 5/2001 Kuo ..... A45C 13/262 16/113.1
6,254,303 B1 * 7/2001 Falat ..... B23B 31/113 403/321
6,256,855 B1 * 7/2001 Schall ..... B25B 7/02 29/275
6,292,979 B1 * 9/2001 Kuo ..... A45C 13/262 16/113.1
6,302,617 B1 * 10/2001 Rumpp ..... B60D 1/52 285/401
6,315,488 B1 * 11/2001 Parker ..... A01B 1/227 403/326
6,357,080 B1 * 3/2002 Tsai ..... A45C 13/262 16/113.1
6,389,626 B1 * 5/2002 Hung ..... B25B 7/00 7/128
6,506,091 B1 * 1/2003 Garpow ..... A63H 33/08 206/216
6,561,866 B1 * 5/2003 Lee ..... A63H 33/06 446/103
6,595,825 B1 * 7/2003 De Wilde ..... A63H 33/067 403/348
6,702,642 B1 * 3/2004 Parein ..... B65D 81/361 446/105
7,194,937 B1 * 3/2007 Melkowits ..... B25B 7/02 81/418
7,553,209 B1 * 6/2009 Sorensen ..... A63H 33/06 446/124
7,644,828 B1 * 1/2010 Klein ..... A63H 33/067 206/509
7,736,211 B2 * 6/2010 Marzetta ..... A63H 33/105 446/113
7,882,674 B2 * 2/2011 Craven ..... E04B 2/18 446/124
8,214,972 B2 * 7/2012 Lai ..... A45C 13/262 16/113.1
D674,032 S * 1/2013 Howard, II ..... D21/698
8,403,723 B1 * 3/2013 Haner ..... A63H 33/08 446/120
8,408,932 B2 * 4/2013 Villarreal ..... H01R 13/6275 439/358
8,458,877 B1 * 6/2013 Falconette ..... B25B 7/10 29/229
8,888,552 B2 * 11/2014 Wizenberg ..... A63H 33/086 446/102
9,126,086 B2 * 9/2015 Howard, II ..... A63B 69/0002
9,272,226 B2 * 3/2016 Samlaska ..... A63H 23/005
2002/0043544 A1 * 4/2002 Caneba ..... A45C 13/262 224/584
2002/0064420 A1 * 5/2002 Lin ..... B25B 7/02 403/217
2002/0115374 A1 * 8/2002 Lavender ..... A63H 33/04 446/85
2003/0235463 A1 * 12/2003 Neumann ..... B25G 1/04 403/329
2004/0082265 A1 * 4/2004 Langton ..... A63H 3/46 446/373
2004/0159749 A1 * 8/2004 Nault ..... H02G 3/0608 248/49
2005/0076484 A1 * 4/2005 Sussenbach ..... F16B 21/186 24/662
2005/0191932 A1 * 9/2005 Lin ..... A63H 33/086 446/85
2005/0272301 A1 * 12/2005 Bruder ..... A63H 33/101 439/409
2008/0134479 A1 * 6/2008 Kolasa ..... A44B 11/266 24/625
2009/0218774 A1 * 9/2009 Lin ..... B23B 31/1071 279/76
2011/0039474 A1 * 2/2011 Bruder ..... A63H 33/101 446/124
2012/0036709 A1 * 2/2012 Wu ..... B25B 7/02 29/764
2012/0273641 A1 * 11/2012 Gorman ..... E06B 9/02 248/316.7
2013/0183085 A1 * 7/2013 Zullig ..... F16B 7/046 403/326
2013/0195547 A1 * 8/2013 De Wilde ..... A63H 33/101 403/330

(56) References Cited

U.S. PATENT DOCUMENTS

| | | | | |
|---|---|---|---|---|
| 2013/0210314 | A1* | 8/2013 | Rottjer | A63H 33/08<br>446/124 |
| 2013/0243523 | A1* | 9/2013 | De Jong | B60R 13/0206<br>403/326 |
| 2016/0136531 | A1* | 5/2016 | Manichon | A63H 3/46<br>446/376 |

* cited by examiner

SNAP-FIT CONNECTOR AND TOY ASSEMBLY HAVING THE SAME

CROSS-REFERENCE TO RELATED APPLICATION

This application claims priority of Taiwanese Application No. 103138058, filed on Nov. 3, 2014.

FIELD OF THE DISCLOSURE

The disclosure relates to a snap-fit connector, more particularly to a snap-fit connector for interconnecting toy blocks.

BACKGROUND OF THE DISCLOSURE

Toy blocks can be separably interconnected through various manners. There is a conventional snap-fit connector including female and male components that are respectively connected to two toy blocks, and that can be interengaged separably for interconnecting the toy blocks. However, the toy blocks are respectively held and moved away from each other to directly separate the female and male components. The abovementioned operation may cause fracture of the conventional snap-fit connector.

SUMMARY OF THE DISCLOSURE

Therefore, an object of the present disclosure is to provide a snap-fit connector that can overcome the aforesaid drawback associated with the prior art.

Accordingly, a snap-fit connector of the present disclosure includes a female component and a male component. The female component has a main body, a retaining hole and two through bores. The retaining hole is formed in an end surface of the main body, and has a non-circular first hole section that is proximate to the end surface, and a second hole section that is distal from the end surface. The second hole section has a size smaller than that of the first hole section. Each of the through bores is formed in a respective one of two lateral surfaces of the main body that are opposite to each other in a direction transverse to the extending direction of the retaining hole, and communicates spatially with the second hole section of the retaining hole. The male component engages separably the female component, and has a base that is retained complementarily in the first hole section of the retaining hole, and two spaced-apart hooks that extend from the base and that are inserted into the second hole section of the retaining hole via the first hole section. Each of the hooks has a resilient arm that is retained in the second hole section, and a protrusion that protrudes from the resilient arm and away from the other one of the hooks, and that is retained in a respective one of the through bores. The protrusion of each of the hooks has an abutment surface that faces toward the base and that abuts against a corresponding one of two bore-defining-surfaces of the main body that respectively define the through bores for preventing separation of the male component from the female component, an inclined guide surface that faces away from the base for being pushed by the main body when the base is inserted into the retaining hole in the female component, and a positioning recess that is formed in the guide surface and that is accessible via the respective one of the through bores.

Another object of the present disclosure is to provide a snap-fit connector module that can overcome the aforesaid drawback associated with the prior art.

Accordingly, a snap-fit connector module of the present disclosure includes a snap-fit connector and a pincer. The snap-fit connector includes a female component and a male component. The female component has a main body, a retaining hole and two through bores. The retaining hole is formed in an end surface of the main body, and has a non-circular first hole section that is proximate to the end surface, and a second hole section that is distal from the end surface. The second hole section has a size smaller than that of the first hole section. Each of the through bores is formed in a respective one of two lateral surfaces of the main body that are opposite to each other in a direction transverse to the extending direction of the retaining hole, and communicates spatially with the second hole section of the retaining hole. The male component engages separably the female component, and has a base that is retained complementarily in the first hole section of the retaining hole, and two spaced-apart hooks that extend from the base and that are inserted into the second hole section of the retaining hole via the first hole section. Each of the hooks has a resilient arm that is retained in the second hole section, and a protrusion that protrudes from the resilient arm and away from the other one of the hooks, and that is retained in a respective one of the through bores. The protrusion of each of the hooks has an abutment surface that faces toward the base and that abuts against a corresponding one of two bore-defining-surfaces of the main body that respectively define the through bores for preventing separation of the male component from the female component, an inclined guide surface that faces away from the base for being pushed by the main body when the base is inserted into the retaining hole in the female component, and a positioning recess that is formed in the guide surface and that is accessible via the respective one of the through bores. The pincer includes a first lever, a driven member connected movably to the first lever, and a second lever connected pivotally to the first lever and coupled to the driven member. The first lever and the driven member respectively have first and second bulges. The second lever is operable to pivot relative to the first lever to drive movement of the driven member relative to the first lever. To separate the female and male components, the first and second bulges of the pincer are first operated to be positioned respectively on the protrusions of the hooks by the positioning recesses, and then the second lever is pressed to drive movement of the second bulge toward the first bulge, so as to respectively push and remove the protrusions from the through bores.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
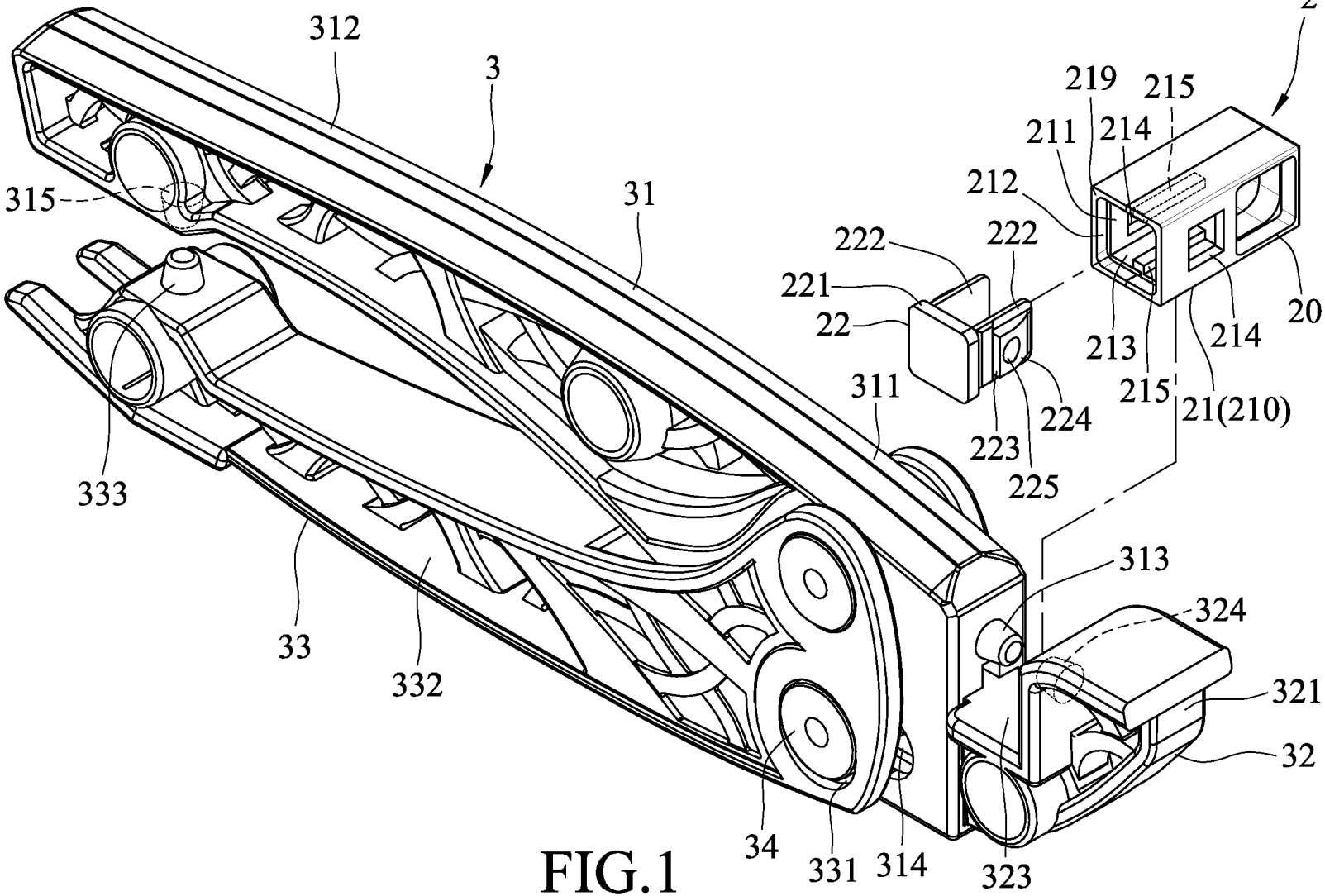
FIG. 1 is a partly exploded perspective view of a first embodiment of a snap-fit connector module according to the disclosure.

Before the present disclosure is described in greater detail, it should be noted that like elements are denoted by the same reference numerals throughout the disclosure.

Figure 2:
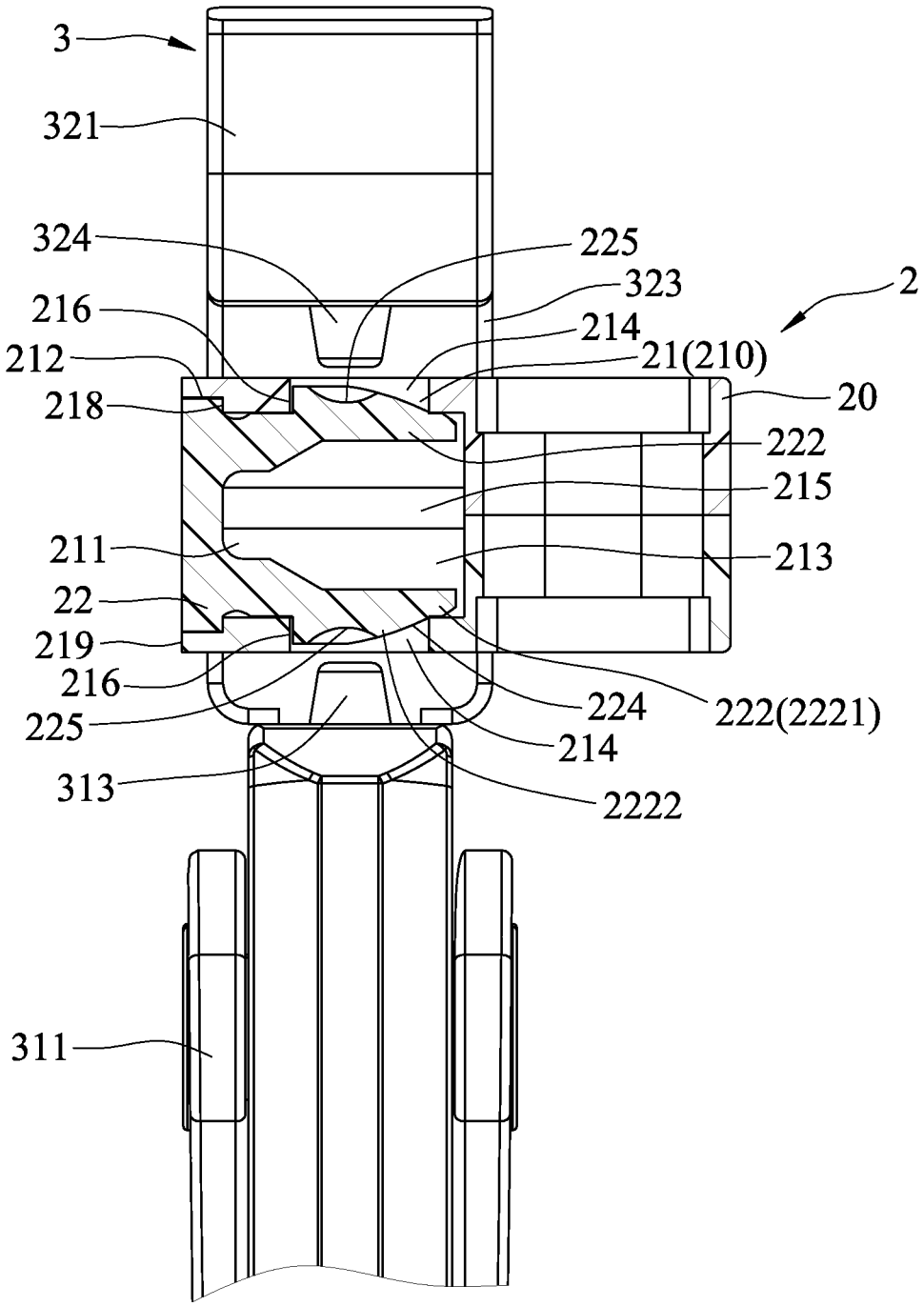
FIG. 2 is a fragmentary partly sectional view of the first embodiment.

As shown in FIGS. 1 and 2, a first embodiment of a snap-fit connector module according to the present disclosure includes a snap-fit connector 2 and a pincer 3.

The snap-fit connector 2 includes a female component 21 and a male component 22.

The female component 21 has a main body 210, a retaining hole 211 and two through bores 214.

The retaining hole 211 is formed in an end surface 219 of the main body 210, and has a non-circular first hole section 212 that is proximate to the end surface 219, and a second hole section 213 that is distal from the end surface 219. The first hole section 212 is rectangular in this embodiment. The second hole section 213 has a size smaller than that of the first hole section 212.

Each of the through bores 214 is formed in a respective one of two lateral surfaces of the main body 210 that are opposite to each other in a direction transverse to the extending direction of the retaining hole 211, and communicates spatially with the second hole section 213 of the retaining hole 211.

The female component 21 further has two spaced-apart rebutting projections 215 projecting from a hole-defining-surface of the main body 210 that defines the retaining hole 211, and located between the through bores 214.

It is noted that in this embodiment, the female component 21 is connected integrally to a toy block 20 that has a through hole. However, the female component 21 may be connected integrally to any toy component such as a joint assembly, another female component or another male component.

The male component 22 engages separably the female component 21, and has a base 221 that is retained complementarily in the first hole section 212 of the retaining hole 211, and two spaced-apart hooks 222 that extend from the base 221 and that are inserted into the second hole section 213 of the retaining hole 211 via the first hole section 212.

The base 221 abuts against a shoulder surface 218 of the main body 210 of the female component 21 that is formed between the first and second hole sections 212, 213 for preventing the male component 22 from being further inserted into the female component 21.

Each of the hooks 222 has a resilient arm 2221 that is retained in the second hole section 213, and a protrusion 2222 that protrudes from the resilient arm 2221 and away from the other one of the hooks 222, and that is retained in a respective one of the through bores 214.

Figure 5:
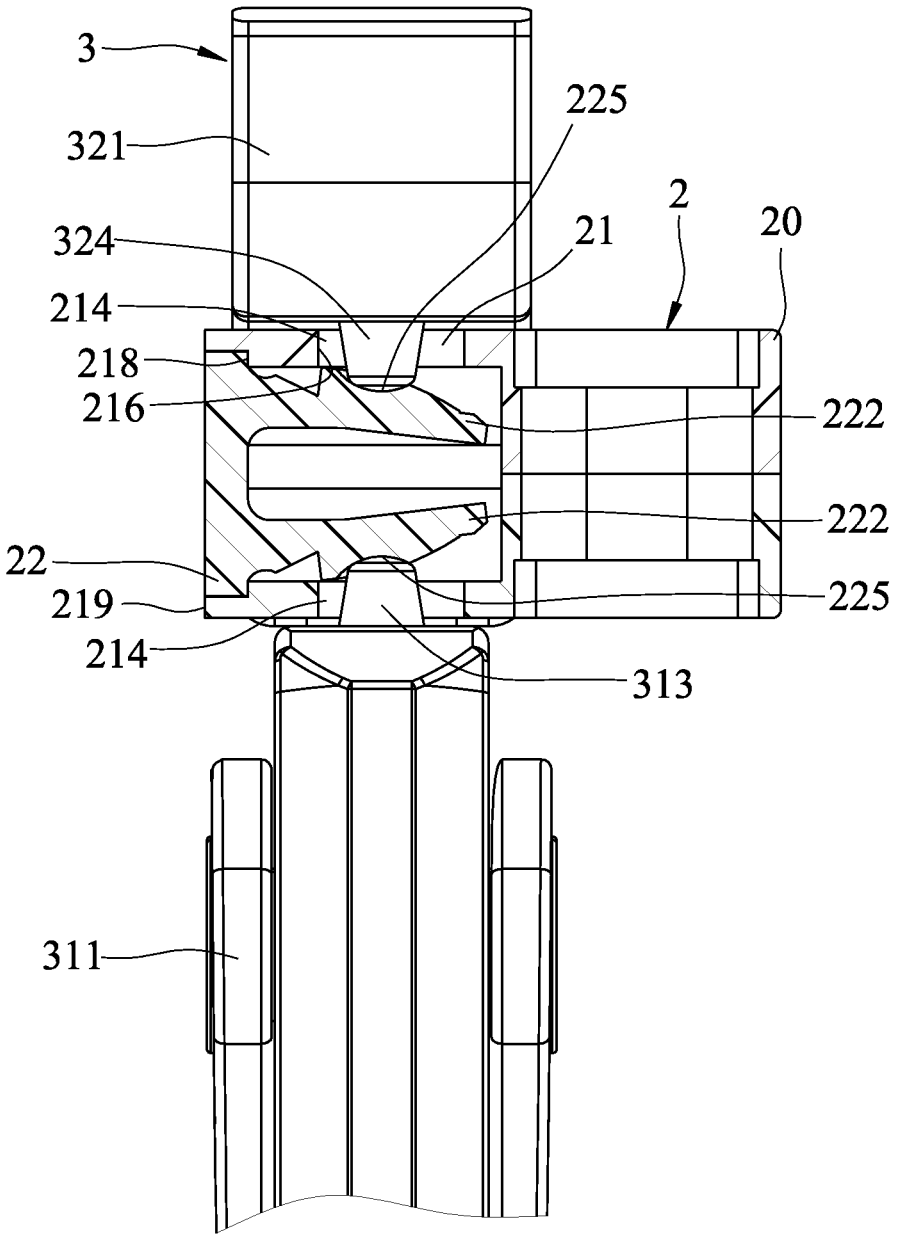
FIG. 5 is a schematic fragmentary partly sectional view of the first embodiment.

The protrusion 2222 of each of the hooks 222 has an abutment surface 223 that faces toward the base 221 and that abuts against a corresponding one of two bore-defining-surfaces 216 of the main body 210 of the female component 21 that respectively define the through bores 214 for preventing separation of the male component 22 from the female component 21, an inclined guide surface 224 that faces away from the base 221 for being pushed by the main body 210 when the base 221 is inserted into the retaining hole 211 in the female component 21, and a positioning recess 225 that is formed in the guide surface 224 and that is accessible via the respective one of the through bores 214 (see FIGS. 2 and 5).

It is noted that, like the female component 21, the base 221 of the male component 22 may be connected integrally to any toy component such as a joint assembly, another female component or another male component.

Figure 3:
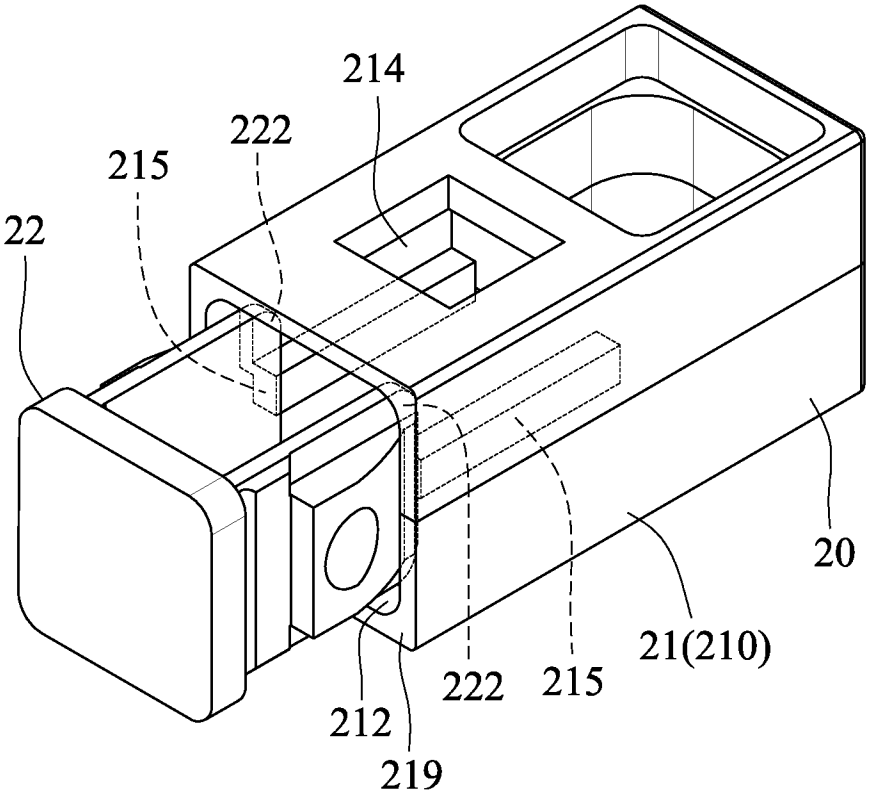
FIG. 3 is a schematic perspective view of a snap-fit connector of the first embodiment.

Referring to FIG. 3, the rebutting projections 215 of the female component 21 are configured such that, when the hooks 222 are inserted into the retaining hole 211 in the female component 21 in such a manner that the protrusions 2222 of the hooks 222 cannot move into the through bores 214, the hooks 222 are obstructed by the rebutting projections 215 so that the base 221 of the male component 22 is prevented from moving into the retaining hole 211. In a variation of the first embodiment, the female component 21 may have only one rebutting projection. 215.

Figure 4:
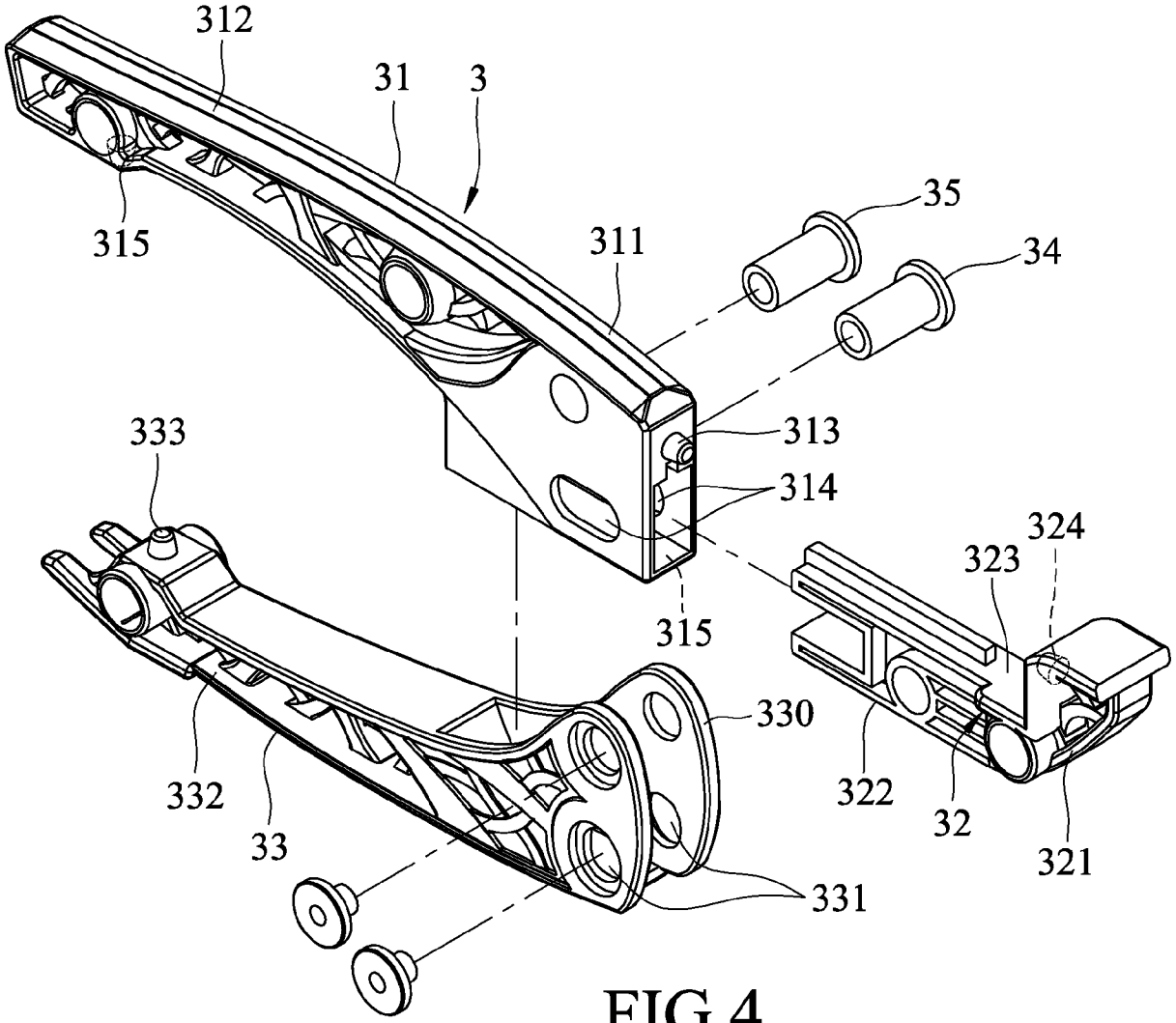
FIG. 4 is an exploded perspective view of a pincer of the first embodiment.

Referring further to FIG. 4, the pincer 3 includes a first lever 31, a driven member 32, a second lever 33 and a sliding bolt assembly 34.

The first lever 31 has a first head section 311, an elongate first holding section 312 that extends from the first head section 311, and a first budge 313 that protrudes from an end of the first head section 311 opposite to the first holding section 312. The first head section 311 is formed with an engaging space 315 and two spaced-apart first guide grooves 314 that communicate spatially with the engaging space 315.

The driven member 32 has a second head section 321 that is spaced apart from the first head section 311 and distal from the first holding section 312, an engaging section 322 that extends from the second head section 321 and that engages movably the engaging space 315 of the first lever 31, and a second bulge 324 that protrudes from the second head section 321 toward the first budge 313. The second head section 321 and the engaging section 322 cooperatively define a limiting space 323 for receiving a portion of the female component 21.

The second lever 33 has a first end section 330 that is connected pivotally to the first head section 311 of the first lever 31 through a pivot bolt assembly 35, and that is formed with two spaced apart second guide grooves 331 extending in a direction oblique to that of the first guide grooves 314, and a second end section 332 that is opposite to the first end section 330 and that is proximate to the first holding section 312.

The sliding bolt assembly 34 extends through the first guide grooves 314, the second guide grooves 331 and the engaging section 322 of the driven member 32, and is movable along the first and second guide grooves 314, 331, such that pivot movement of the second lever 33 relative to the first lever 31 drives movement of the driven member 32 relative to the first lever 31 along the first guide grooves 314.

Referring to FIGS. 1, 2 and 5, to separate the female and male components 21, 22, the female component 21 is disposed between the first and second head sections 311, 321 and is retained in the limiting space 323 to be positioned relative to the driven member 32.

The first and second bulges 313, 324 of the pincer 3 are first operated to be respectively inserted into the through bores 214, and to be positioned respectively on the protrusions 2222 of the hooks 222 by the positioning recesses 225. Then, the second lever 33 is pressed to pivot relative to the first lever 31 to drive movement of the second bulge 324 toward the first bulge 314, so as to respectively push and remove the protrusions 2222 from the through bores 214. As a result, the abutment surfaces 223 of the hooks 222 of the male component 22 are respectively separated from the bore-defining-surfaces 216 of the female component 21 to permit separation of the male component 22 from the female component 21.

Figure 6:
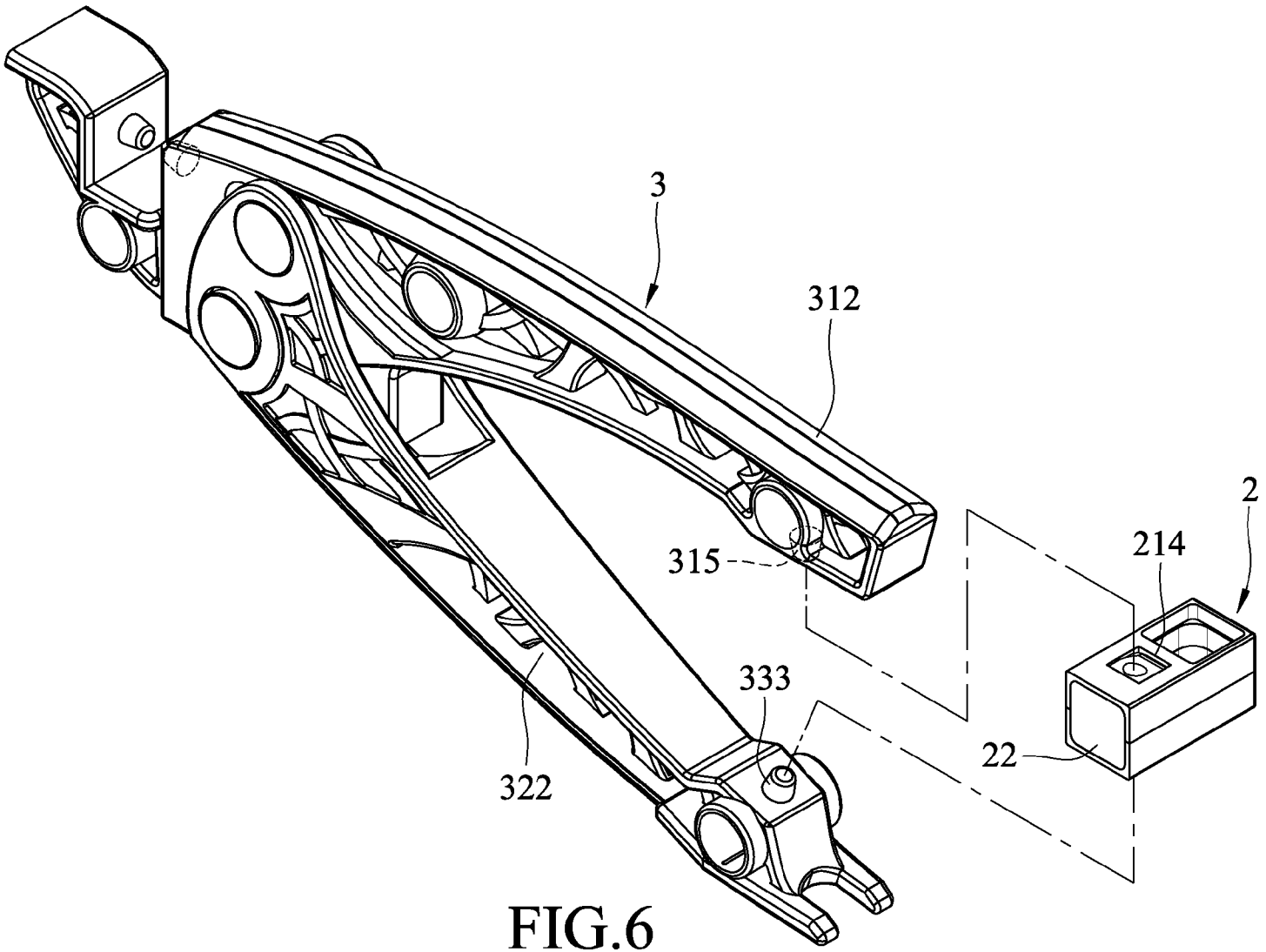
FIG. 6 is a schematic perspective view of the first embodiment.
Figure 7:
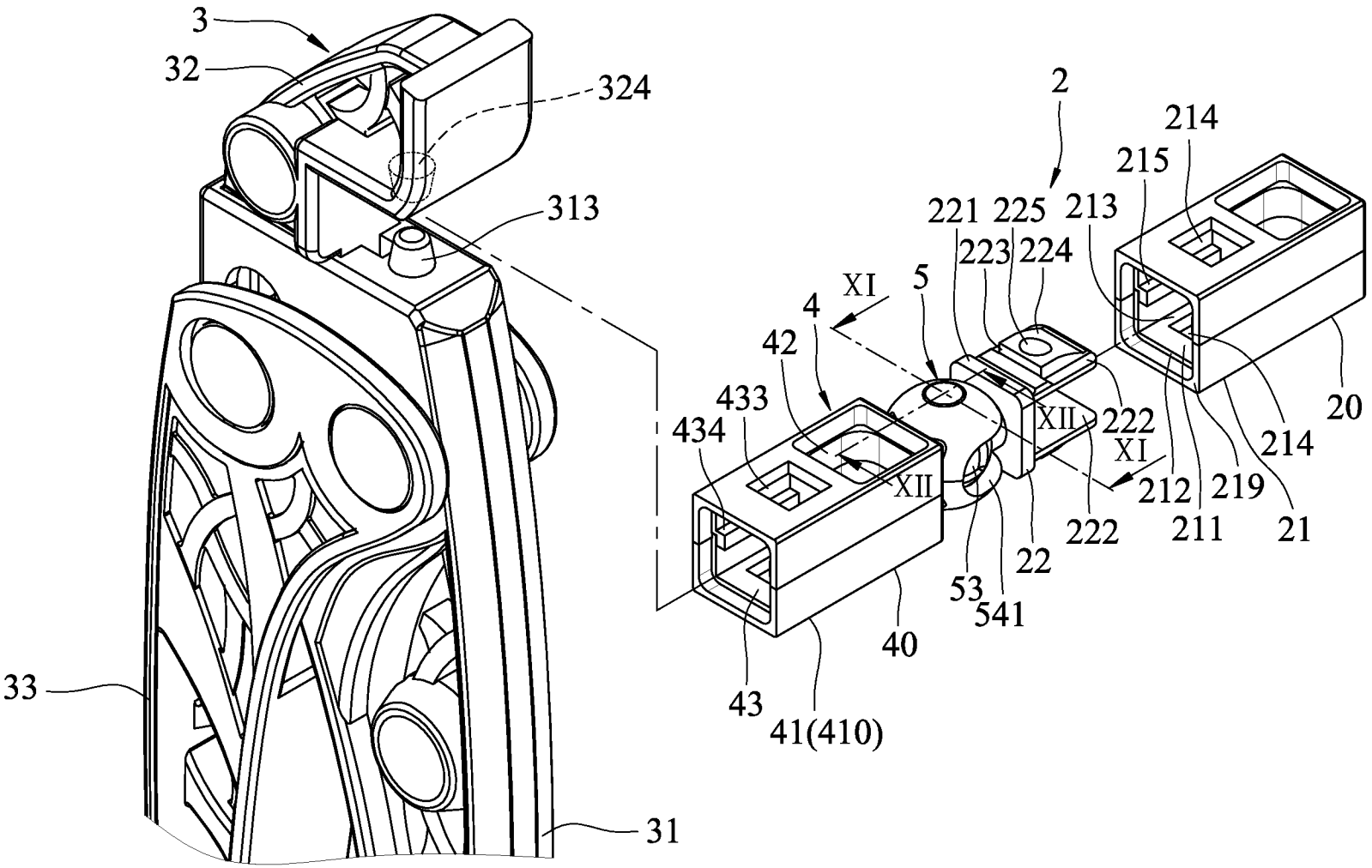
FIG. 7 is a fragmentary partly exploded perspective view of a second embodiment of the snap-fit connector module according to the disclosure.
Figure 8:
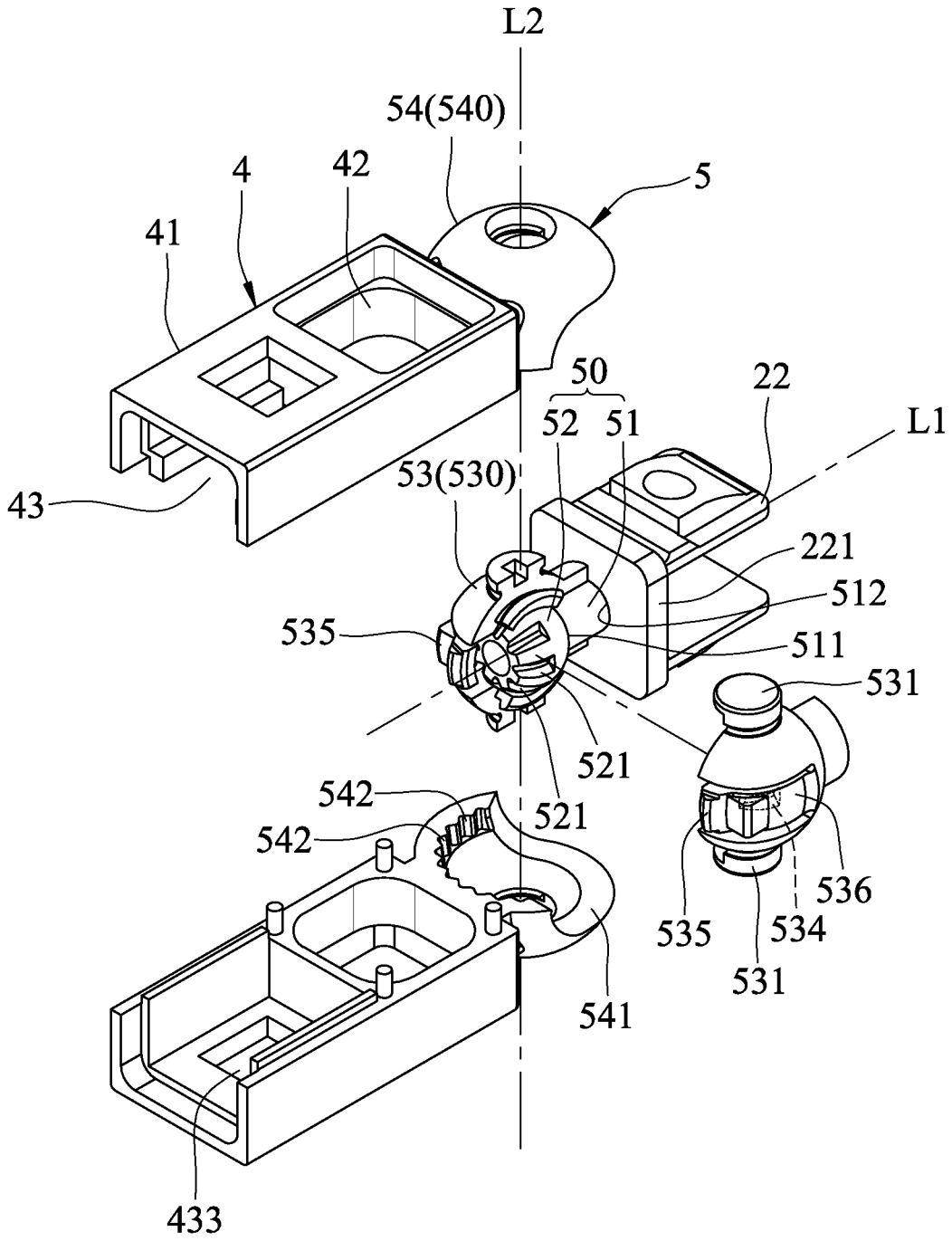
FIG. 8 is a partly exploded perspective view of a joint assembly and a block of the second embodiment.
Figure 9:
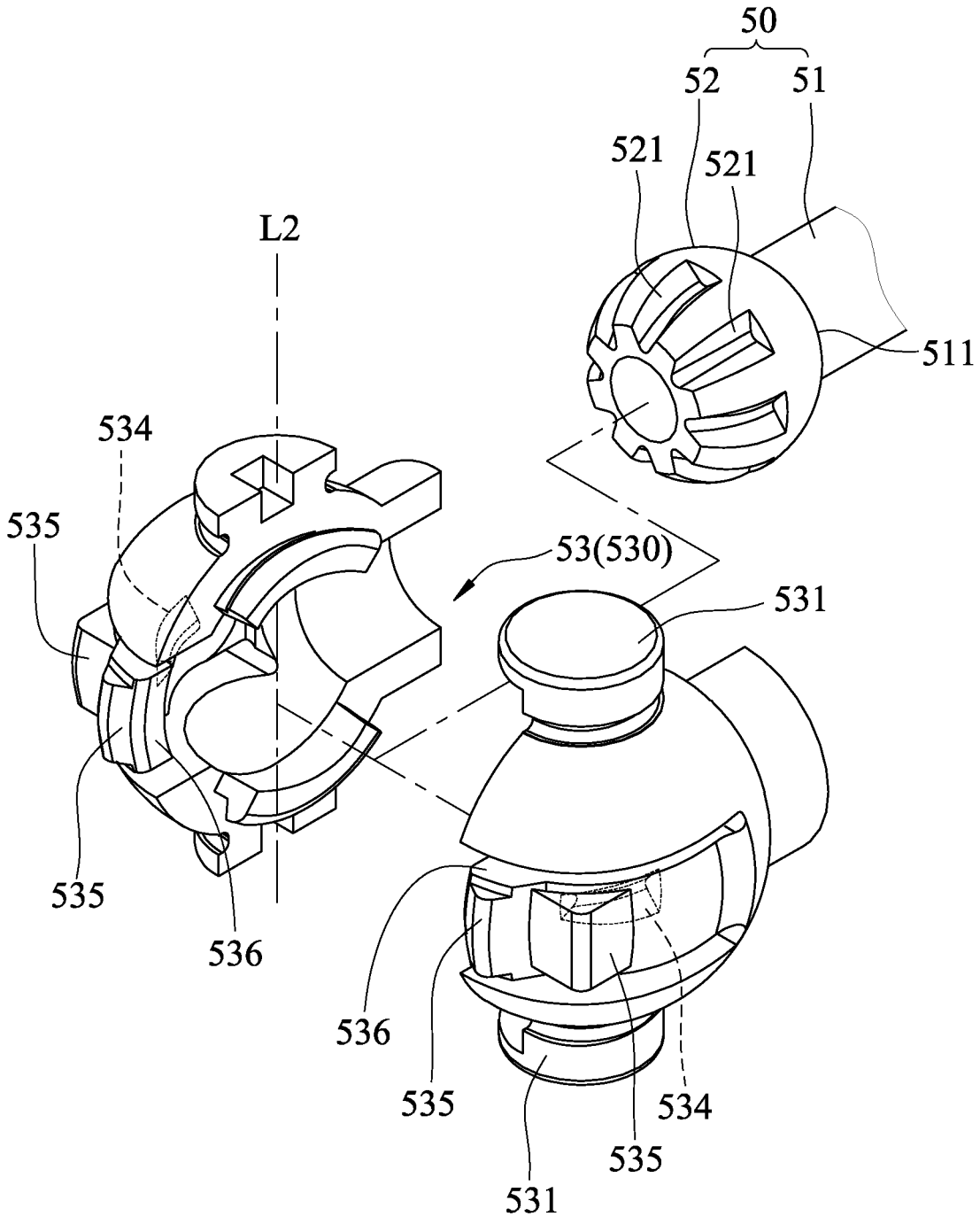
FIG. 9 is a fragmentary exploded perspective view of an inner casing and a stud of the joint assembly of the second embodiment.
Figure 10:
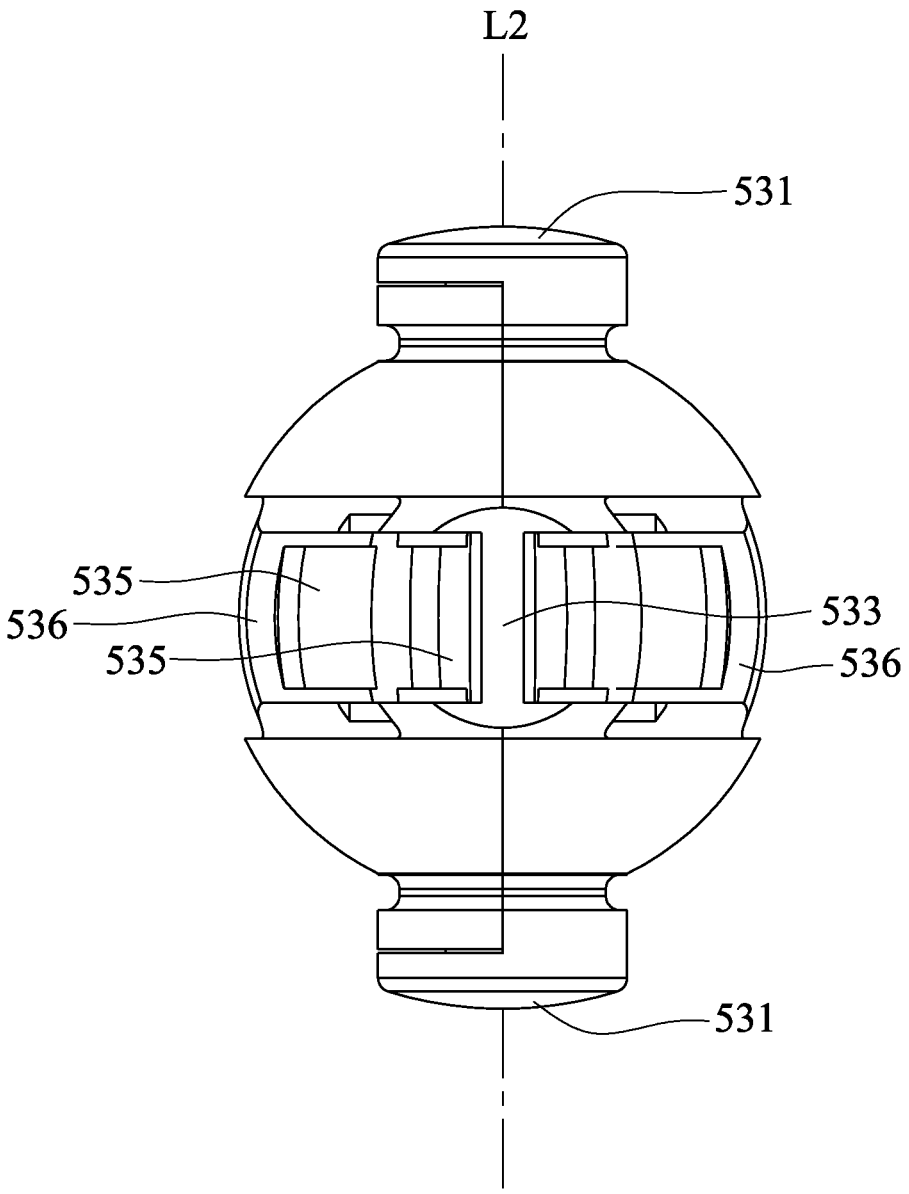
FIG. 10 is a front view of the inner casing of the joint assembly of the second embodiment.
Figure 11:
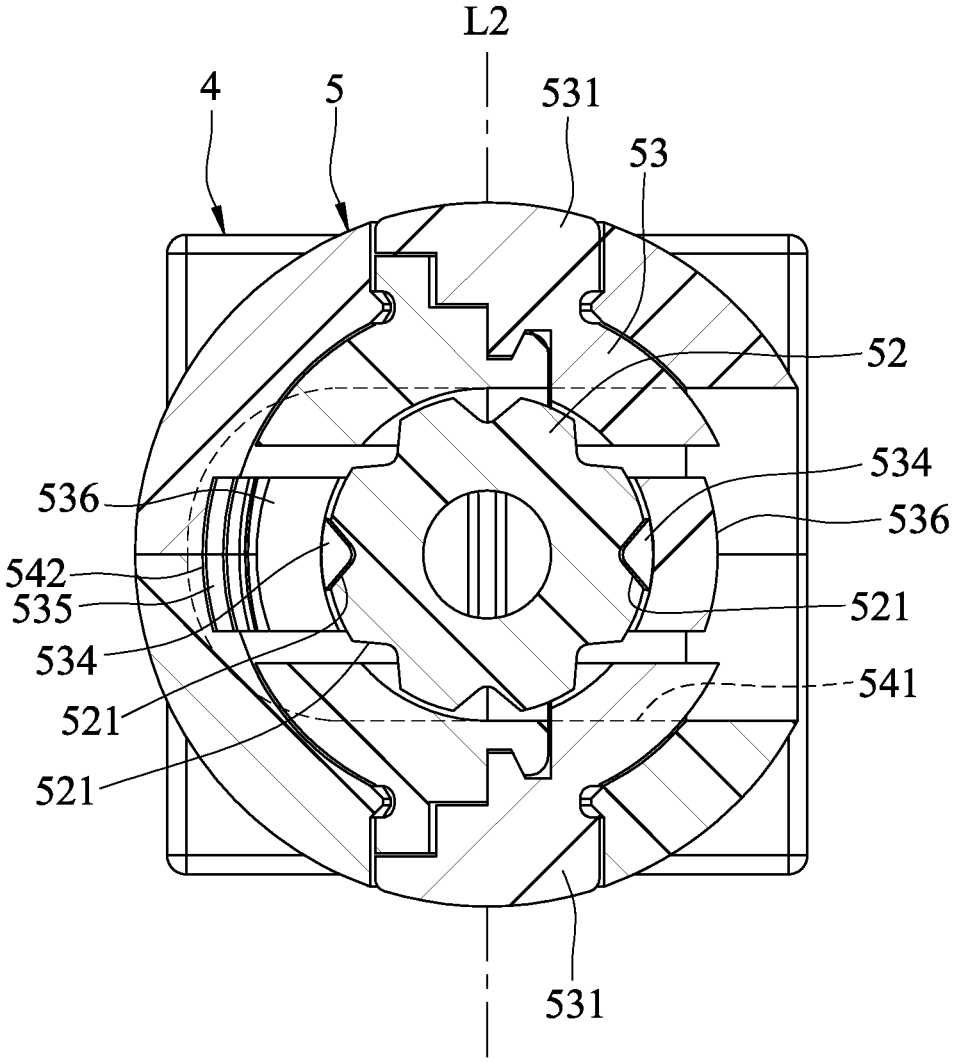
FIG. 11 is a sectional view of the joint assembly of the second embodiment taken along line XI-XI in FIG. 7.
Figure 12:
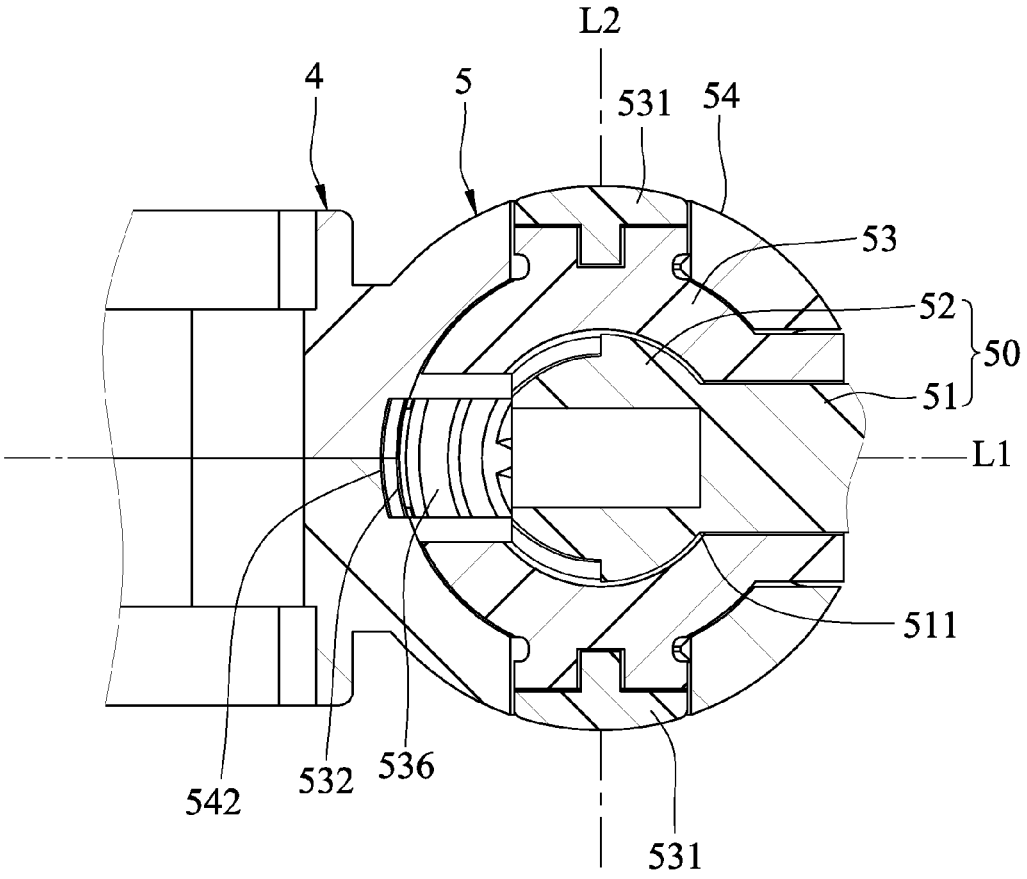
FIG. 12 is another sectional view of the joint assembly of the second embodiment taken along line XII-XII in FIG. 7.

Referring to FIG. 6, the first lever 31 further has a third bulge 315 that protrudes from a distal portion of the first holding section 312 and toward the second end section 332 of the second lever 33. The second lever 33 further has a fourth bulge 333 that protrudes from the second end section 332 and toward the third bulge 315.

The pincer 3 can be operated in an alternative manner to separate the female and male components 21, 22. That is, the third and fourth bulges 315, 333 are first operated to be respectively inserted into the through bores 214, and to be positioned respectively on the protrusions 2222 of the hooks 222 by the positioning recesses 225. Then, the first and second levers 31, 33 are pivoted toward each other to move the third and fourth bulges 315, 333 toward each other, so as to respectively push and remove the protrusions 2222 from the through bores 214. Similarly, the abutment surfaces 223 of the hooks 222 of the male component 22 are respectively separated from the bore-defining-surfaces 216 of the female component 21 to permit separation of the male component 22 from the female component 21.

Referring to FIGS. 7 to 12, a second embodiment of the snap-fit connector module according to the present disclosure is similar to the first embodiment, and further includes a toy block 4 and a joint assembly 5.

The toy block 4 has integrally-interconnected first and second sections 40, 41. The first section 40 is formed with a through hole 42 for being mounted with another toy block (not shown). The second section 41 is configured to be the same as the female component 21, and has main body 410, a retaining hole 43, two through bores 433 and two spaced-apart rebutting projections 434.

The joint assembly 5 interconnects the male component 22 and the block 4, and includes a stud 50, an inner casing 53 and an outer casing 54.

The stud 50 includes a rod segment 51 and a ball segment 52. The rod segment 51 extends along a first axis (L1), and has opposite first and second ends 511, 512 that are disposed along the first axis (L1). The second end 512 of the rod segment 51 is connected co-movably to one of the male component 22 and the block 4. In this embodiment, the second end 512 of the rod segment 51 is connected co-movably to the base 221 of the male component 22.

The ball segment 52 of the stud 50 is connected co-movably to the first end 511 of the rod segment 51, and has a plurality of spaced-apart first positioning structures 521 that are arranged about the first axis (L1). In this embodiment, each of the first positioning structures 521 is configured as a groove.

The inner casing 53 is mounted around the stud 50 and rotatable relative to the stud 50 about the first axis (L1), and has a second axis (L2), a casing body 530, two axle portions 531, two second positioning structures 534 and four third positioning structures 535. In this embodiment, the inner casing 53 consists of two casing halves.

The second axis (L2) is perpendicular to the first axis (L1).

The casing body 530 has a main portion that is formed with a through groove 533 extending about the second axis (L2), and two resilient plates 536 that are connected to the main portion and disposed in the through groove 533. In a variation of the embodiment, the casing body 530 may have only one resilient plate 536 connected to the main portion and disposed in the through groove 533.

The axle portions 531 are disposed respectively on two opposite sides of the casing body 530 along the second axis (L2), and extend along the second axis (L2).

The second positioning structures 534 are provided respectively on inner surfaces of the resilient plates 536. Each of the second positioning structures 534 engages removably one of the first positioning structures 521 for positioning the inner casing 53 relative to the stud 50. In this embodiment, each of the second positioning structures 534 is configured as an engaging block.

The third positioning structures 535 are spaced apart from each other and arranged about the second axis (L2). Two of the third positioning structures 535 are provided on an outer surface of one of the resilient plates 536. The other two of the third positioning structures 535 are provided on an outer surface of the other one of the resilient plates 536. In this embodiment, each of the third positioning structures 535 is configured as an engaging block.

The outer casing 54 is mounted around the inner casing 53, and is connected co-movably to the other one of the male component 22 and the block 4. In this embodiment, the outer casing 54 is connected co-movably to one side of the first section 40 of the block 4 opposite to the second section 41, and is connected rotatably to the inner casing 53 via the axle portions 531 such that the outer casing 54 is rotatable relative to the inner casing 53 about the second axis (L2).

The outer casing 54 has a casing body 540 and a plurality of fourth positioning structures 542. The casing body 540 is formed with an arc-shaped through groove 541 centered at the second axis (L2) and extending by 120 degrees. The through groove 541 permits the stud 50 to extend therethrough and to move therewithin, so as to limit the rotation of the outer casing 54 relative to the inner casing 53. It is noted that the through groove 541 may extend by a different angle so as to adjust the limitation of the rotation of the outer casing 54 relative to the inner casing 53.

The fourth positioning structures 542 are provided on an inner surface of the casing body 540, and are arranged about the second axis (L2). Each of the third positioning structures 535 engages removably one of the fourth positioning structures 542 so that the outer casing 54 is positioned relative to the inner casing 53. In this embodiment, each of the fourth positioning structures 542 is configured as a groove.

In this embodiment, the outer casing 54 is co-rotatable with the inner casing 53 relative to the stud 50 about the first axis (L1), and is rotatable relative to the inner casing 53 about the second axis (L2), such that the toy block 4 has two rotational degrees of freedom relative to the male component 22 via the joint assembly 5. Moreover, the toy block 4 can be retained at a specific angle relative to the male component 22 through the engagement between the first and second positioning structures 521, 534 and between the third and fourth positioning structures 535, 542.

Figure 13:
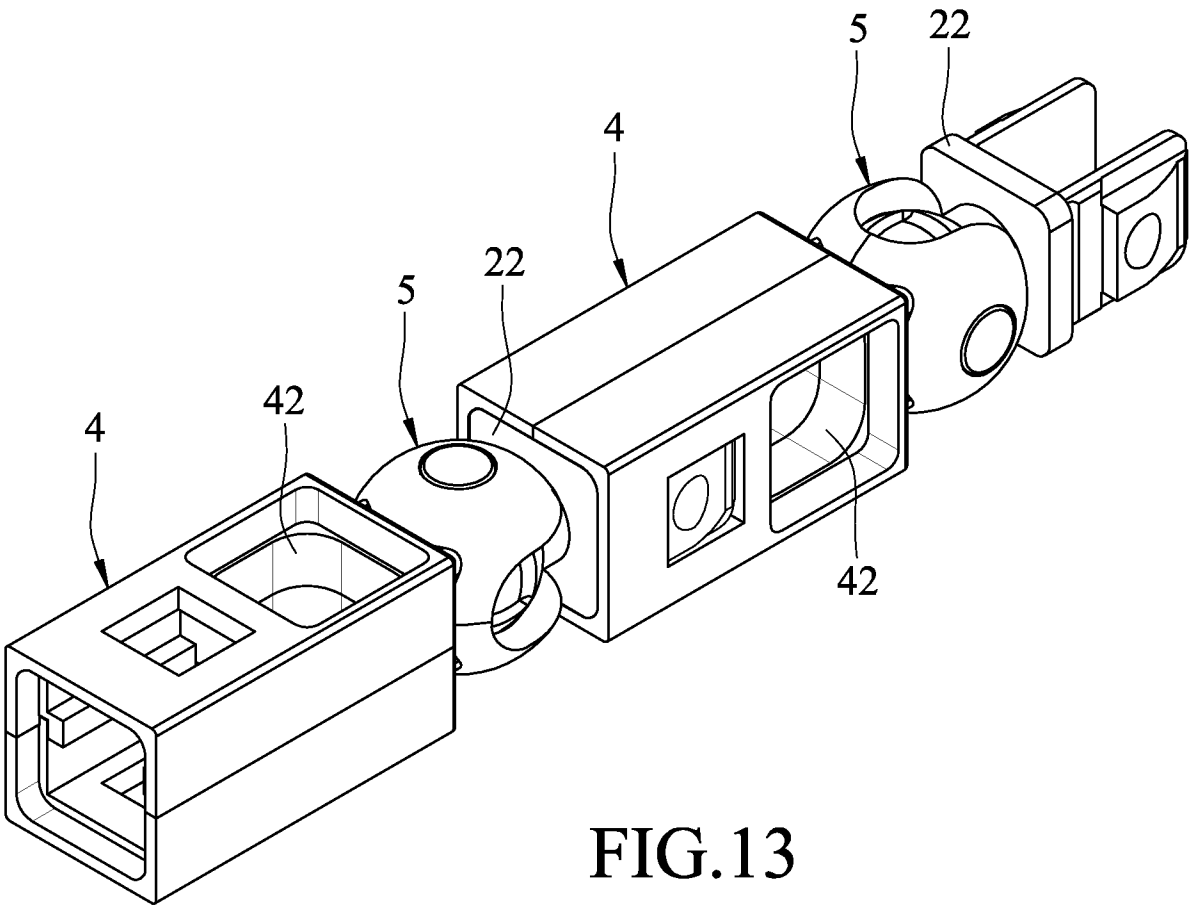
FIG. 13 is a schematic assembled perspective view of the second embodiment.
Figure 14:
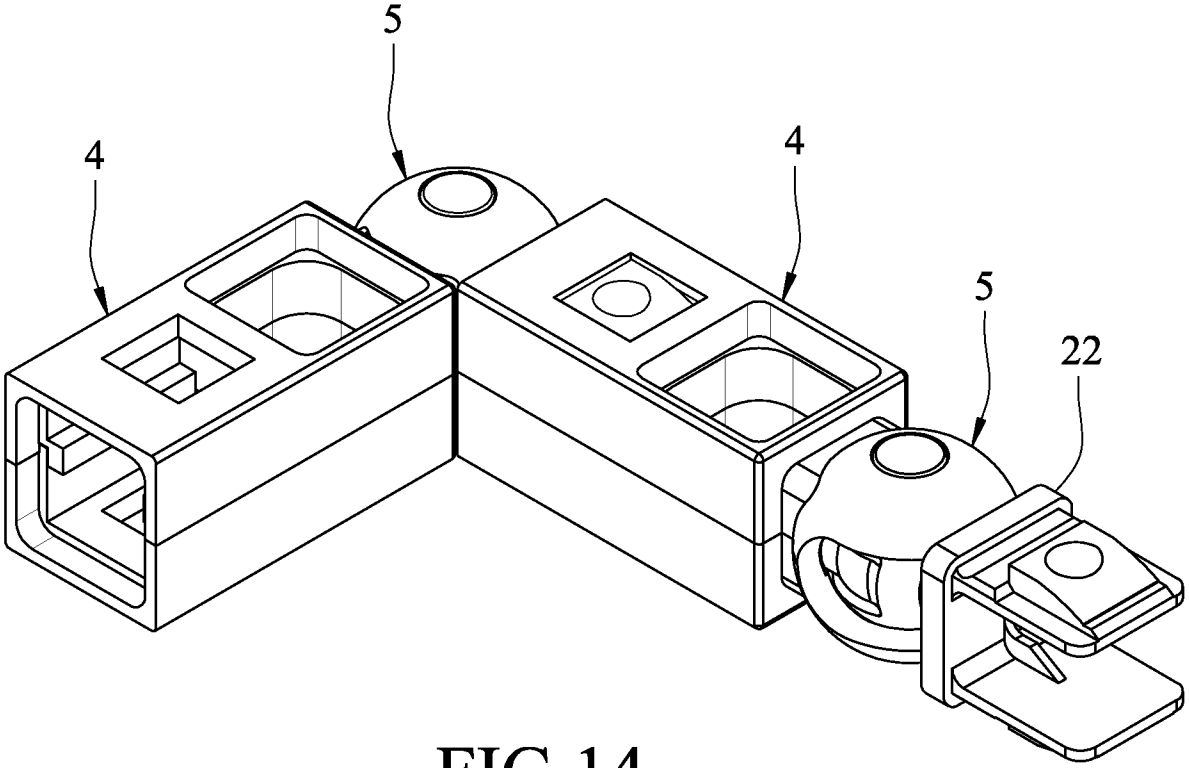
FIG. 14 is another schematic assembled perspective view of the second embodiment.

Referring further to FIGS. 13 and 14, two of the assemblies of the male component 22, the joint assembly 5 and the toy block 4 can be connected in series, and can form different shapes through the joint assembly 5 of each of the assemblies.

Figure 15:
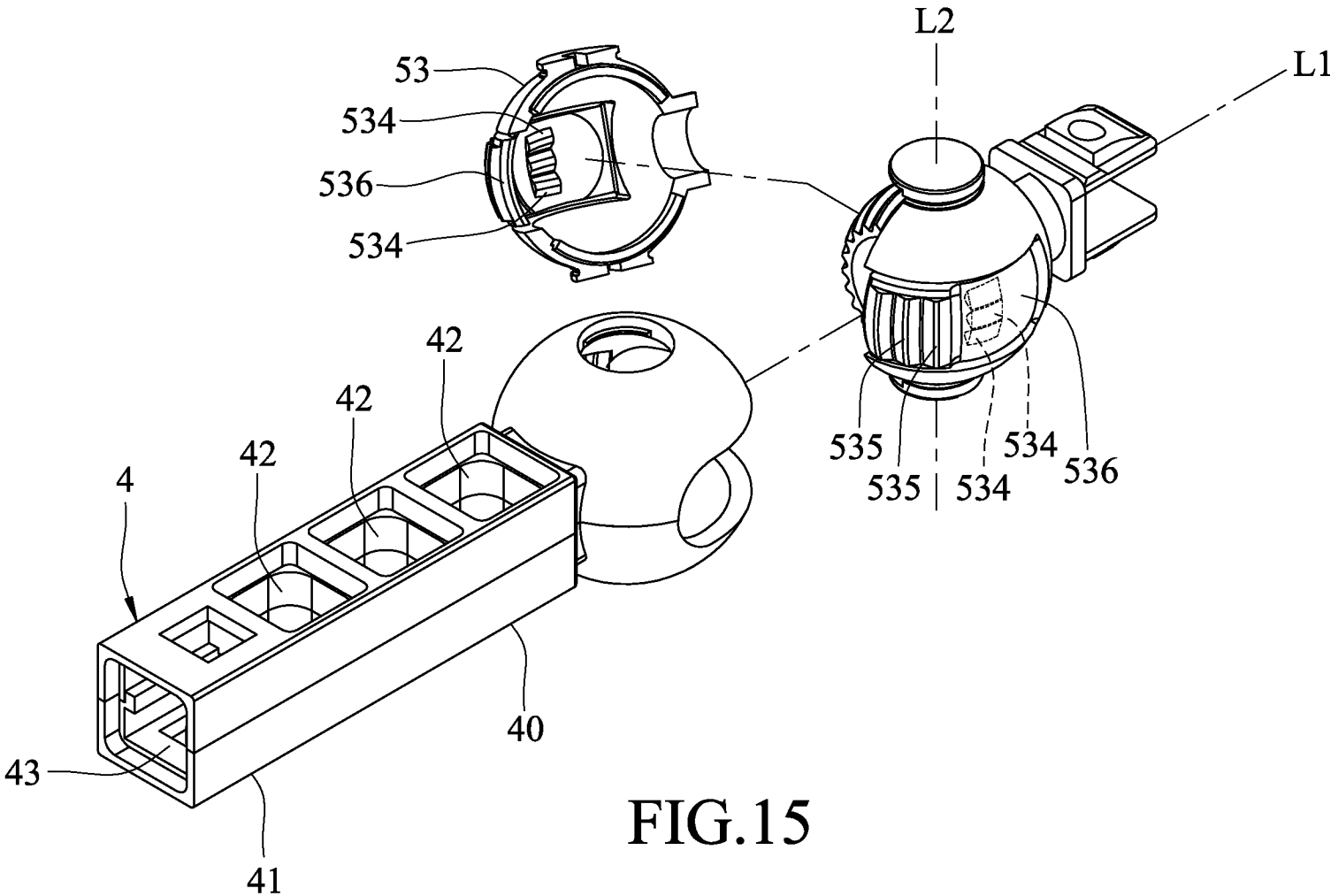
FIG. 15 is a partly exploded perspective view of a third embodiment of the snap-fit connector module according to the disclosure.

Referring to FIG. 15, a third embodiment of the snap-fit connector module according to the present disclosure is similar to the second embodiment. The differences between the second and third embodiments are that, in the third embodiment, the first section 40 of the toy block 4 is formed with three through holes 42, and the inner casing 53 of the joint assembly 5 has six second positioning structures 534 and six third positioning structures 535.

Three of the second positioning structures 534 are provided on the inner surface of one of the resilient plates 536. The other three of the second positioning structures 534 are provided on the inner surface of the other one of the resilient plates 536. Three of the third positioning structures 535 are provided on the outer surface of one of the resilient plates 536. The other three of the third positioning structures 535 are provided on the outer surface of the other one of the resilient plates 536. It is noted that the numbers of the second and third positioning structures 534, 535 and the number of the through holes 42 of the toy block 4 can be varied in a variation of this embodiment.

Figure 16:
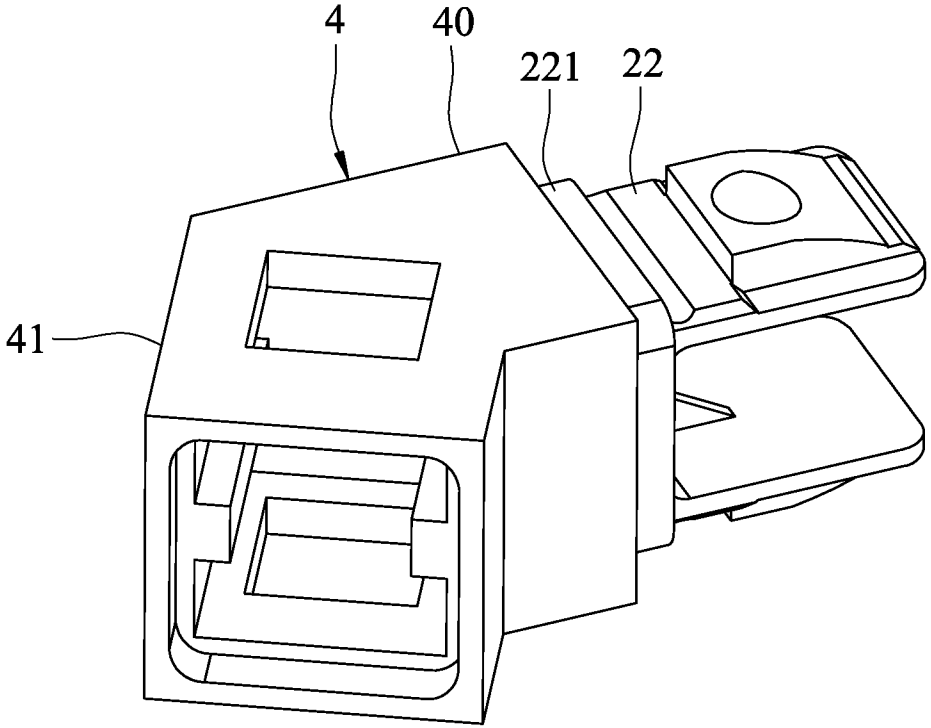
FIG. 16 is a perspective view of a fourth embodiment of the snap-fit connector module according to the disclosure.

Referring to FIG. 16, a fourth embodiment of the snap-fit connector module according to the present disclosure includes the male component 22 and a toy block 4 connected integrally to the base 221 of the male component 22. The second section 41 of the toy block 4 extends in a direction oblique to that of the first section 40.

Figure 17:
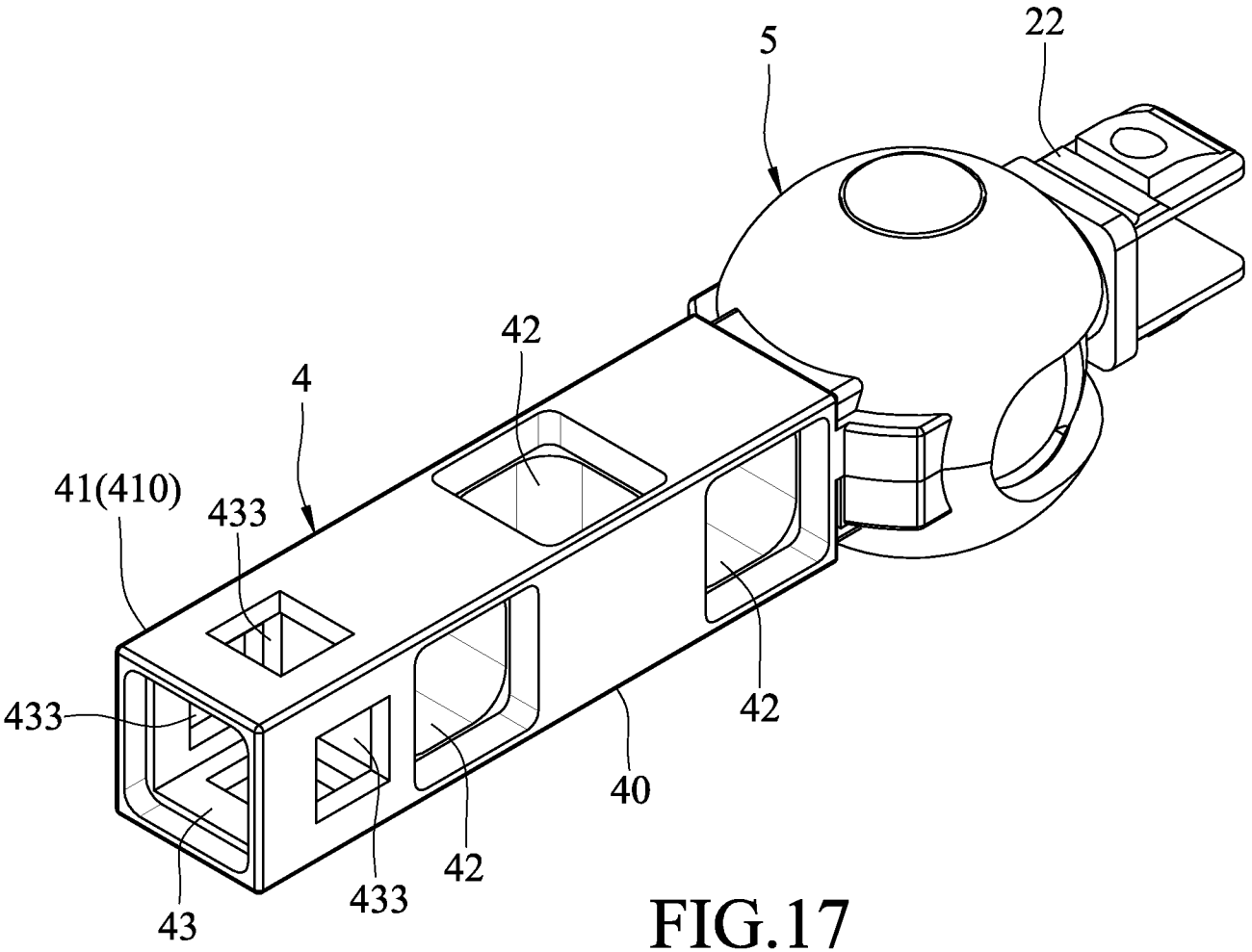
FIG. 17 is a perspective view of a fifth embodiment of the snap-fit connector module according to the disclosure.

Referring to FIG. 17, a fifth embodiment of the snap-fit connector module according to the present disclosure is similar to the second embodiment. The first section 40 of the toy block 4 of the third embodiment is formed with through holes 42 that extend in different directions. The second section 41 of the toy block 4 is configured to be similar to that of the second embodiment, and has a main body 410, a retaining hole 43 and four through bores 433. It is noted that the rebutting projections 434 (see FIG. 7) are omitted in the fifth embodiment.

Figure 18:
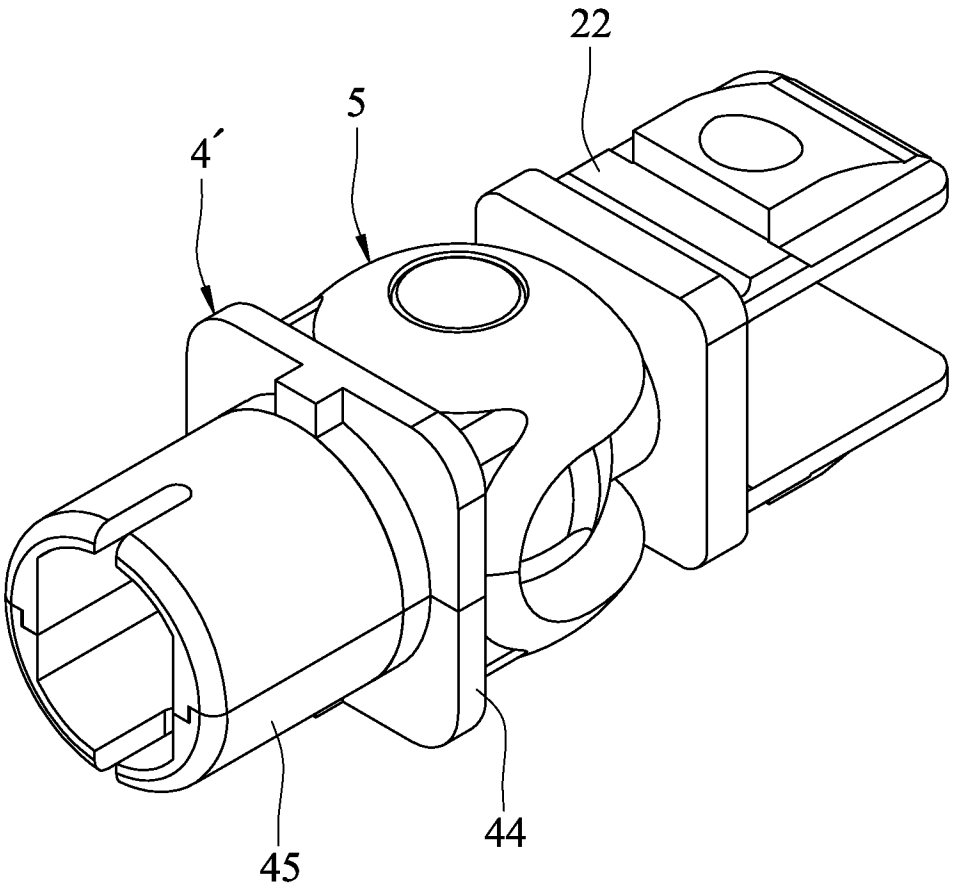
FIG. 18 is a perspective view of a sixth embodiment of the snap-fit connector module according to the disclosure.

Referring to FIG. 18, a sixth embodiment of the snap-fit connector module according to the present disclosure includes the male component 22, the joint assembly 5 and a toy block 4' that are interconnected. The toy block 4' has a base section 44 connected integrally to the joint assembly 5, and a tubular section 45 extending away from the joint assembly 5 from one side of the base section 44 opposite to the joint assembly 5. The tubular section 45 can be inserted into another toy block (not shown) to interconnect the toy block 4' and the other toy block.

Figure 19:
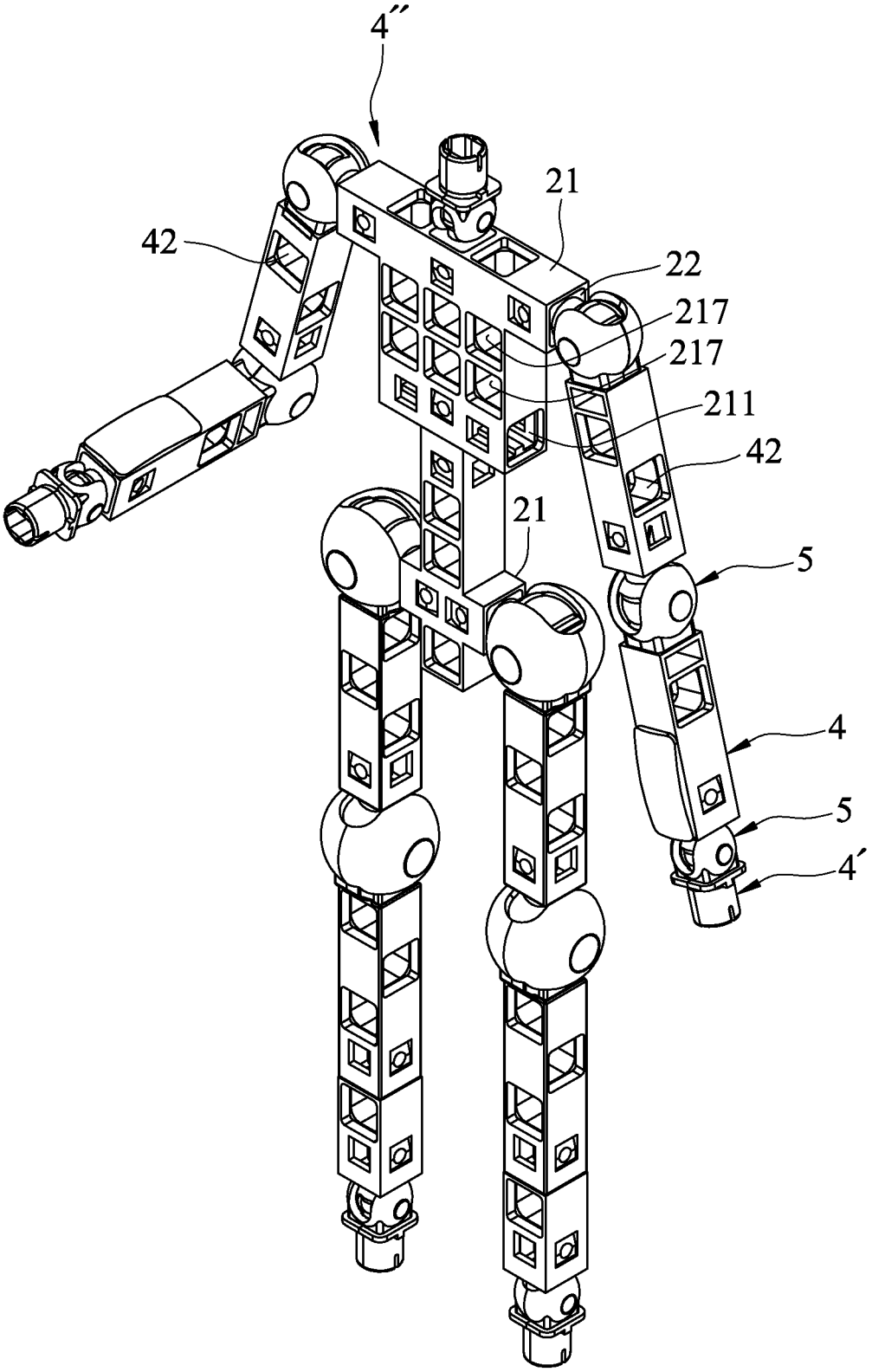
FIG. 19 is a perspective view of a toy assembly consisting of different embodiments of this disclosure.

Referring to FIG. 19, a toy assembly is shown to consist of different embodiments and variations of the embodiments of this disclosure to form a human-like skeleton. A main block 4" is configured to be the body of the human-like skeleton, and has a plurality of the female components 21 and a plurality of through holes 217 formed therethrough. It is noted that the configuration of the toy assembly can be altered arbitrarily, and is not limited to such.

Figure 20:
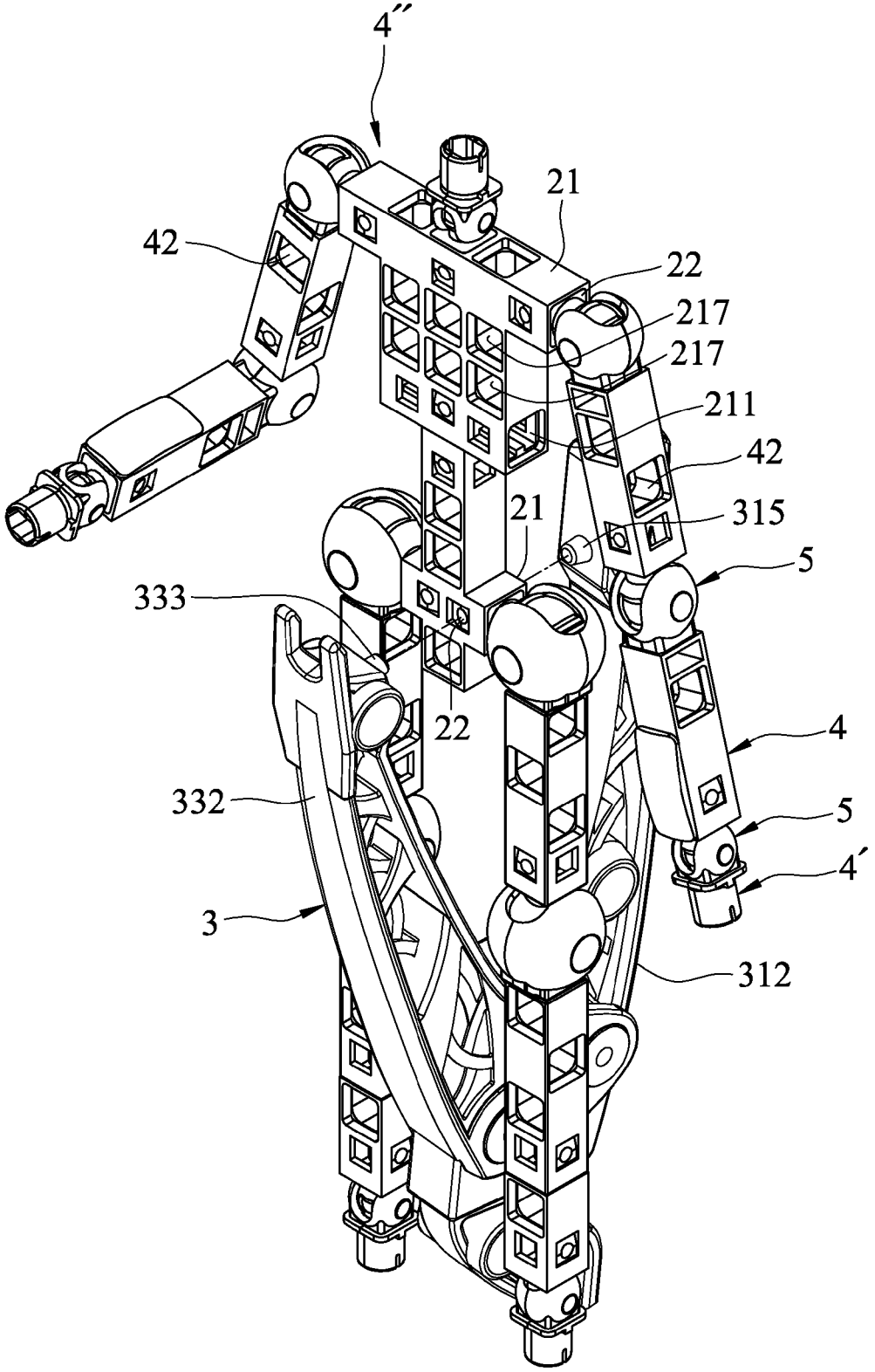
FIG. 20 is a schematic perspective view illustrating disassembling operation of the toy assembly in FIG. 19.

Referring to FIG. 20, to separate a female component 21 that is located at a lower portion of the main block 4" and a male component 22 of one of the limbs of the human-like skeleton, since the female component 21 cannot be retained in the limiting space 323 due to geometry, the pincer 3 is operated in the alternative manner to separate the female and male components 21, 22.

The advantages of this disclosure are as follows:

1. During operation of the separation between the female and male components 21, 22, the first and second bulges 313, 324 of the pincer 3 can be positioned respectively on the protrusions 2222 of the hooks 222 by the positioning recesses 225 to facilitate operation of the pincer 3.

2. During operation of the separation between the female and male components 21, 22, the female component 21 can be retained in the limiting space 323 to be positioned relative to the driven member 32 to aid the alignment among the positioning recesses 225 and the first and second bulges 313, 324.

3. The pincer 3 can operated in the alternative manner to separate the female and male components 21, 22 when the female component 21 cannot be retained in the limiting space 323 due to geometry.

4. Each of the female and male components 21, 22 can be connected integrally to any type of toy block to meet various demands.

5. The outer casing 54 of the joint assembly 5 is co-rotatable with the inner casing 53 relative to the stud 50 about the first axis (L1), and is rotatable relative to the inner casing 53 about the second axis (L2), such that the outer casing 54 has two rotational degrees of freedom relative to the stud 50. Moreover, the abovementioned two rotational movements have the same pivot point, so that the joint assembly 5 is suitable for constructing a human-like skeleton.

6. The outer casing 54 can be retained at a specific angle relative to the stud 50 through the engagement between the first and second positioning structures 521, 534 and between the third and fourth positioning structures 535, 542.

7. By virtue of the variety of this disclosure, a toy assembly consisting of the embodiments of this disclosure can be constructed to simulate more kinds of objects.

8. The female and male components 21, 22 of the snap-fit connector 2 are configured to be interengaged firmly, and would not be separated easily due to accidental impact.

While the present disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A snap-fit connector module comprising:

a snap-fit connector including a female component and a male component, said female component having a main body, a retaining hole and two through bores, said retaining hole extending into said main body from an end surface of said main body, and having a non-circular first hole section that is proximate to said end surface, and a second hole section that is located in said main body and that is distal from said end surface, said second hole section having a size smaller than that of said first hole section, each of said through bores being formed in a respective one of two lateral surfaces of said main body that are opposite to each other in a direction transverse to the extending direction of said retaining hole, and communicating spatially with said second hole section of said retaining hole, said male component engaging separably said female component, and having a base that is retained complementarily in said first hole section of said retaining hole, and two spaced-apart hooks that extend from said base and that are inserted into said second hole section of said retaining hole via said first hole section, each of said hooks having a resilient arm that is retained in said second hole section, and a protrusion that protrudes from said resilient arm and away from the other one of said hooks, and that is retained in a respective one of said through bores, said protrusion of each of said hooks having an abutment surface that faces toward said base and that abuts against a corresponding one of two bore-defining-surfaces of said main body that respectively define said through bores for preventing separation of said male component from said female component, an inclined guide surface that faces away from said base for being pushed by said main body when said base is inserted into said retaining hole in said female component, and a positioning recess that is formed in said guide surface and that is accessible via the respective one of said through bores; and a pincer including a first lever, a driven member connected movably to said first lever, and a second lever connected pivotally to said first lever and coupled to said driven member, said first lever and said driven member respectively having first and second bulges, said second lever being operable to pivot relative to said first lever to drive movement of said driven member relative to said first lever;

wherein, to separate said female and male components, said first and second bulges of said pincer are first operated to be positioned respectively on said protrusions of said hooks by said positioning recesses of said hooks, and then said second lever is pressed to drive movement of said second bulge toward said first bulge, so as to respectively push and remove said protrusions from said through bores.

2. The snap-fit connector module as claimed in claim 1, wherein said driven member further has an engaging section that engages movably said first lever, said first lever being formed with a first guide groove, said second lever being formed with a second guide groove, said pincer further including a bolt assembly that extends through said first and second guide grooves and said engaging section of said driven member, and that is movable along said first and second guide grooves, such that pivot movement of said second lever relative to said first lever drives movement of said driven member relative to said first lever along said first guide groove.

3. The snap-fit connector module as claimed in claim 2, wherein said driven member further has a limiting space for receiving said female component such that said female component is positioned relative to said driven member during separation operation of said snap-fit connector.

4. The snap-fit connector module as claimed in claim 1, wherein said first lever further has a third bulge, said second lever having a fourth bulge, said first and second levers being interconnected such that, to separate said female and male components, said third and fourth bulges are first operated to be positioned respectively on said protrusions of said hooks by said positioning recesses, and then said first and second levers are pivoted toward each other to move said third and fourth bulges toward each other, so as to respectively push and remove said protrusions from said through bores.

5. The snap-fit connector module as claimed in claim 1, wherein said snap-fit connector further includes a block and a joint assembly, said joint assembly interconnecting said male component and said block, and including a stud, an inner casing and an outer casing, said stud including a rod segment and a ball segment, said rod segment extending along a first axis, and having opposite first and second ends that are disposed along the first axis, said second end of said rod segment being connected co-movably to one of said male component and said block, said ball segment of said stud being connected co-movably to said first end of said rod segment, said inner casing being mounted around said stud and rotatable relative to said stud about the first axis, and having a second axis that is perpendicular to the first axis, said outer casing being mounted around said inner casing and rotatable relative to said inner casing about the second axis, and being connected co-movably to the other one of said male component and said block.

6. The snap-fit connector module as claimed in claim 5, wherein said ball segment of said stud has a plurality of first positioning structures arranged about the first axis, said inner casing having a casing body and at least one second positioning structure that is provided on an inner surface of said casing body, said second positioning structure engaging removably one of said first positioning structures for positioning said inner casing relative to said stud.

7. The snap-fit connector module as claimed in claim 6, wherein said casing body has a main portion, and at least one resilient plate that is connected to said main portion, said second positioning structure being provided on an inner surface of said resilient plate.

8. The snap-fit connector module as claimed in claim 5, wherein said inner casing has a casing body and at least one third positioning structure that is provided on an outer surface of said casing body, said outer casing having a plurality of fourth positioning structures that are arranged about the second axis, said third positioning structure engaging removably one of said fourth positioning structures so that said outer casing is positioned relative to said inner casing.

9. The snap-fit connector module as claimed in claim 8, wherein said casing body has a main portion, and at least one resilient plate that is connected to said main portion, said third positioning structure being provided on an outer surface of said resilient plate.

10. The snap-fit connector module as claimed in claim 5, wherein said outer casing has a casing body that is formed with an arc-shaped through groove centered at the second axis, said through groove permitting said stud to extend therethrough, so as to limit the rotation of said outer casing relative to said inner casing.

11. The snap-fit connector module as claimed in claim 5, wherein said inner casing has a casing body, and two axle portions that are disposed respectively on two opposite sides of said casing body along the second axis, and that extend along the second axis, said outer casing being connected rotatably to said inner casing via said axle portions.

12. The snap-fit connector module as claimed in claim 5, wherein said block has at least one portion that is configured to be the same as said female component.

13. The snap-fit connector module as claimed in claim 1, wherein said female component further has at least one rebutting projection that projects from a hole-defining-surface of said main body defining said retaining hole, and that is located between said through bores such that, when said hooks are inserted into said retaining hole in said female component in such a manner that said protrusions of said hooks cannot move into said through bores, said hooks are obstructed by said rebutting projection so that said base of said male component is prevented from moving into said retaining hole.

* * * * *